United States Patent [19]

Leithem

[11] 4,295,929

[45] Oct. 20, 1981

[54] PROCESS FOR ACID SULFITE DIGESTION OF WOOD

[75] Inventor: Phyllis C. Leithem, McCleary, Wash.

[73] Assignee: International Telephone and Telegraph Corp., New York, N.Y.

[21] Appl. No.: 131,813

[22] Filed: Mar. 19, 1980

Related U.S. Application Data

[63] Continuation-in-part of Ser. No. 54,425, Jul. 3, 1979, abandoned.

[51] Int. Cl.[3] ..... D21C 3/06

[52] U.S. Cl. ..... 162/83; 162/84

[58] Field of Search ..... 162/83, 84, 85, 86

[56] References Cited

U.S. PATENT DOCUMENTS

| | | | |
|---|---|---|---|
| 1,880,042 | 9/1932 | Richter | 162/84 |
| 3,523,060 | 8/1970 | Herdle et al. | 162/83 |

*Primary Examiner*—William F. Smith

*Attorney, Agent, or Firm*—J. B. Raden; H. J. Holt

[57] ABSTRACT

The production of chemical pulp by the acid sulfite digestion process is improved by increasing the ratio by weight of combined $SO_2$ to wood to a range of from 4 to 12 (based on one part of combined $SO_2$ to 100 parts of dry wood) and by increasing the minimum average rate of heating to the substantially maximum cooking temperature to 40° C. per hour.

13 Claims, 2 Drawing Figures

PROCESS FOR ACID SULFITE DIGESTION OF WOOD

Figure 1:
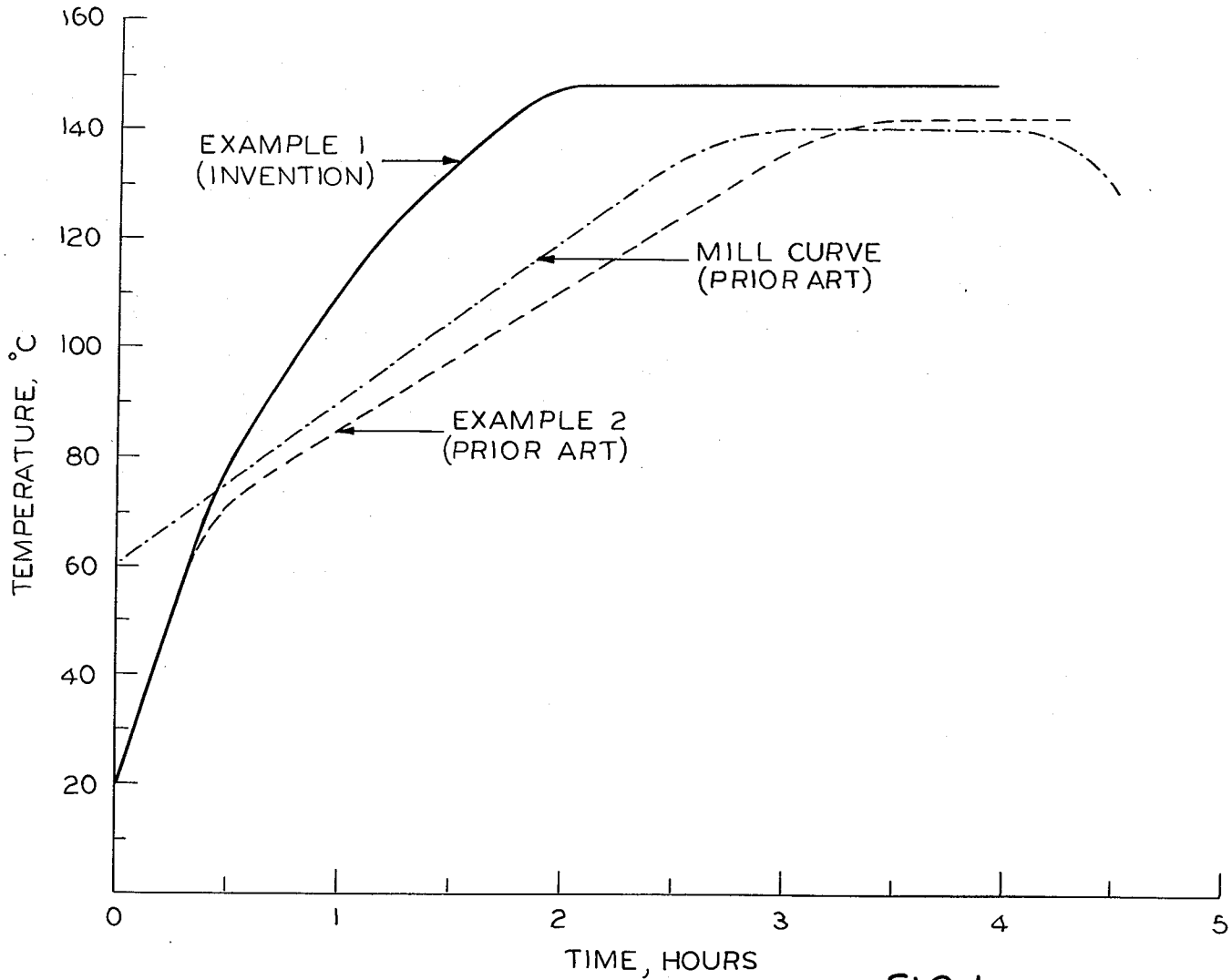

This application is a continuation-in-part of copending application Ser. No. 054,425, filed July 3, 1979 abandoned.

This invention relates to a process for the acid sulfite digestion of wood.

The acid sulfite digestion process (sometimes referred to as acid bisulfite) has been and continues to be widely used for the production of high quality pulps. The acid sulfite process possesses the versatility of being capable of use for producing a variety of pulp grades, ranging from paper grades containing relatively large amounts of hemicellulose to high purity dissolving grade chemical pulps having very small amounts of hemicellulose.

Increasing the acidity of the cooking acid in such processes increases hydrolysis of both the cellulose and hemicelluloses. Thus, for paper grade cellulose where it is desirable to preserve hemicelluloses, less acidity produces higher yield pulps with more hemicellulose. Conversely, dissolving grade pulps require higher acidity to reduce hemicellulose content.

One of the key components of the cooking acid in acid sulfite processes is so-called "combined $SO_2$," generally defined as the amount of $SO_2$ bound as neutral sulfite. Combined $SO_2$ has a basic character. It has been widely assumed for many years in the pulping industry that low levels of combined $SO_2$ are necessary for dissolving pulp grades to develop the acidity necessary during cooking to reduce hemicellulose content.

The acid sulfite digestion process has always been characterized by the long time period required to reach maximum cooking temperature. Normally, acid sulfite digestion also requires critical control of the time-temperature schedule, particularly the time to reach the critical temperature (110° to 125° C.), a temperature below which full penetration of the wood chips with the cooking acid must occur. Quite frequently heating is interrupted or retarded for about an hour at about 110°-125° c. to complete penetration and prevent a so-called burnt cook from occurring. Total time to maximum temperature for an acid sulfite mill digester typically ranges from 3 to 5 hours for soluble base liquors and longer for insoluble base liquor. Attempts to shorten this time period have resulted in poor delignification and excessive carbohydrate degradation.

It is a primary object of the present invention to provide a process for producing chemical pulp which process has increased flexibility by allowing a much enlarged range of acceptable cooking parameters.

It is an additional object of the present invention to provide a process for lowering the production costs for producing chemical cellulosic pulp.

It is yet another object of this invention to provide a process for producing acid sulfite pulp which produces a spent sulfite liquor effluent which is less corrosive than prior effluents and which is more amenable to recovery processes.

It is still an additional object of this invention to provide a process for producing chemical pulps at lower lignin content which are more easily bleached than prior chemical pulps.

The present invention involves the discovery that the proportion of combined $SO_2$ used in the digestion process can be varied as a function of the rate of heating. An increase in the proportion of combined $SO_2$ used in the digestion process combined with an increase in the heating rate allows a considerable shortening of the total digestion time. The discovery of this relationship in the acid sulfite process between the amount of combined $SO_2$ and cooking rate has, insofar as is known, never before been recognized. The process of the invention uses amounts of combined $SO_2$ normally used for high hemicellulose content paper pulps and previously believed incapable of producing low hemicellulose dissolving pulps.

Specifically, the process of the invention comprises the digestion of wood to produce chemical pulp by the acid sulfite digestion process by heating in a closed vessel wood chips in an acid sulfite liquor having a concentration of free $SO_2$ no greater than 16% to a maximum cooking temperature no greater than 180° C. and at a maximum pressure no greater than 170 psig for a period of time sufficient to defiber the wood, the ratio by weight of one part of combined $SO_2$ to 100 parts of dry wood being from 4 to 12 and the minimum average rate of heating to a temperature which is the substantially maximum cooking temperature being 40° C. per hour.

The success of the rapid heating in the process of the invention contradicts well accepted theory that a sufficient period of time must be allowed for base penetration or impregnation to avoid so-called burnt cooks. Hence, acid sulfite pulping technology specifies rather slow rates of heating to ensure penetration of cooking liquor to the center of the chips, for example, 10°-30° C. or in some instances as high as 35° C. per hour. The rates of heating for the present process are greater than 40° C. per hour, frequently greater than 50° C. per hour and may be greater than 100° C. per hour with properly designed digesting equipment.

"Substantially maximum cooking temperature" as used herein is the temperature of the digester at the end of the rapid rise to cooking temperature. This temperature may subsequently be slightly exceeded prior to termination of digestion. The "average rate of heating" as used herein is the quotient of the difference between the starting temperature of the digester and the substantially maximum temperature divided by the time from start of heating the digester to substantially maximum temperature.

Figure 2:
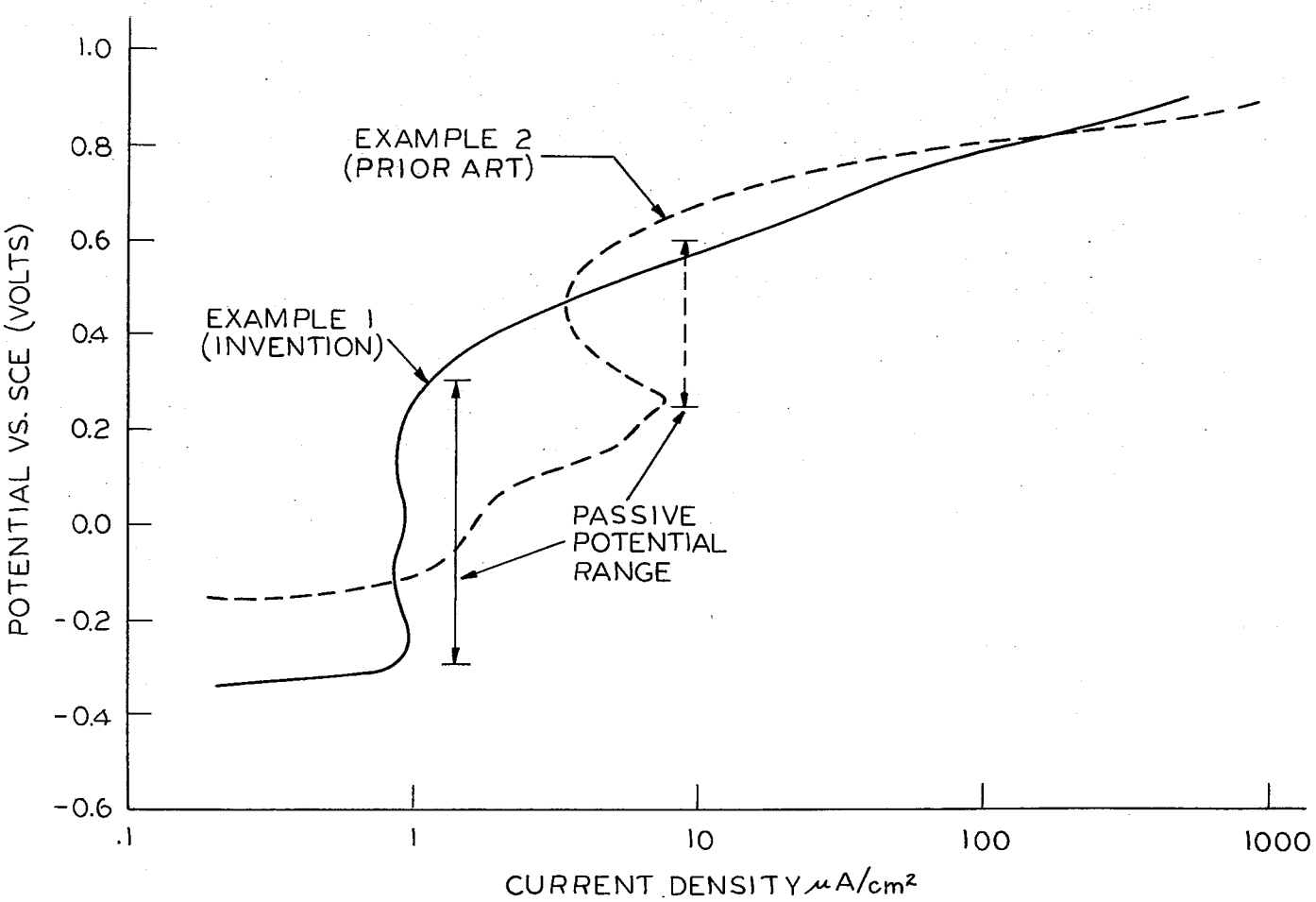

The invention will be better understood by reference to the accompanying drawing in which:

FIG. 1 is a graph of three different time-temperature cooking curves comparing a typical curve of the invention with prior art mill and laboratory digestion curves, and FIG. 2 is a graph of polarization curves of spent sulfite liquor of the invention as compared to prior art spent sulfite liquors to show the difference in corrosive behavior.

A principal advantage of the invention is an increase in productivity resulting from an approximately 10-25% reduction in digestion time. In conventional acid sulfite digestion processes, time to maximum temperature normally ranges from 3 to 5 hours in a commercial pulping operation. In the present invention, this time is reduced to 2 hours or less when using a hot (e.g. 60°-85° C.) liquor as is customary in a commercial operation. In the laboratory, or in other instances where the starting cooking liquor is at ambient temperature, this time is still reduced to 2½ hours or less in accordance with the invention. In many cases, this heating time will be less than 1½ hours and may range to as low as one hour or even less. Moreover, as will be brought out more fully below, pulp quality and yields may be improved. In addition, spent sulfite liquor effluent from the digestion process has physical and chemical characteristics which are less corrosive and are more compatible with effluent recovery systems.

Technically, the process of the invention is classified in the acid sulfite range because of the relatively high ratio of total $SO_2$ to combined $SO_2$ and the resulting low pH of the cooking liquor. The ratio of total $SO_2$ to combined $SO_2$ on a weight basis ranges from about 4:1 to 12:1 in the process of the invention and the pH of the digester liquor ranges from about 1 to 2. However, the actual levels of combined $SO_2$ used in the present process and hence the combined $SO_2$ to wood charged are typical of bisulfite pulping. In the preferred practice of the invention, the ratio by weight of one part of combined $SO_2$ to 100 parts of dry wood will range from 4.5 to 9.0 and, even more preferably, will be a minimum of 5. Conventional acid sulfite pulping at these relatively high combined levels is extremely slow and pulp hemicellulose levels are distinctly higher than those achieved via combined levels in accordance with the present invention. Although the invention is useful in multi-stage or continuous processes, the process of the invention will preferably be a single stage digestion process. The prior art teaches that faster heating rates may be used by chip impregnation prior to digestion. Such pre-impregnation is not necessary to obtain the advantages of the invention. The invention is particularly suitable for soluble base digestion processes using sodium or ammonium base cooking liquors.

As will be shown below, the process may be used to produce pulp of unique analytical properties which contradict results expected from either conventional acid sulfite or conventional bisulfite pulping data. In addition, the use of rapid heat input in a single stage process to achieve cooking temperature without specifically allowing for a base impregnation period is unique to both types of pulping technology. Pulp yields in accordance with the invention are about 45% which is typical of conventional aqueous sulfite processes. (Yields are identified in the Examples as percentages of "screened yields" which are defined below.)

The process of the present invention is carried out in dilute aqueous solution at conventional acid sulfite digestion pressures. It does not involve large increases in $SO_2$ concentration. If the concentration of $SO_2$ in the cooking liquor were to be increased substantially over the dilute concentration normally used in acid sulfite processes, digestion pressures would have to be correspondingly increased. This results from the higher vapor pressures of uncombined $SO_2$, particularly as cooking temperatures are approached, and the consequent necessity of increased pressures to prevent the loss of $SO_2$. Moreover, the invention does not require the presence in the cooking liquor of lower alcohols or other organic solvents. The present invention involves an alteration of the amount of one specific chemical present in the cooking liquor in relatively small quantities, combined $SO_2$. Free $SO_2$, and thus total cooking chemicals, may also be increased to keep the process in the acid sulfite range. However, the free $SO_2$ concentration of the cooking liquor introduced into the digester should not be greater than 16% (16 grams of $SO_2$ per 100 ml of liquor), will usually be from about 4 to 12% and even more preferably from 5 to 10%. As the cook is heated to maximum temperature and pressure, the solubility of free $SO_2$ goes down. Thus the amount of free $SO_2$ at maximum pressure will normally not exceed 10% after pressure is relieved. The maximum pressure should be about 170 psig (1170 KPa(g)) and normally this maximum will be from 70 to 150 psig (482–1034 KPa(g)), pressures which are conventional for acid sulfite digestion.

The liquor to wood ratio will normally range from 3:1 to about 6:1 based on liters of cooking acid added to kilograms of oven dried wood. Using too little liquor outside this range would present problems in covering chips to assure adequate cooking; too much liquor would be impractical for commercial operation. Typical mill liquor to wood ratios range from 4–5. It should be noted that additional moisture entering the digester with the chips is typically not included in this calculation, but would result in relatively small additional dilution. If the liquor to wood ratio is varied in the present invention, a corresponding variation should be made in the concentration of combined $SO_2$ in the cooking acid so that the combined $SO_2$ to wood range is between 4 and 12. For example, a cooking acid containing 1.2 g/dl combined $SO_2$ will result in a combined $SO_2$ to wood ratio of 6 to 1 (kg/100 kg O.D. wood) when cooking liquor is used at a 5:1 liquor:wood ratio. However, to achieve the same combined $SO_2$ to wood ratio, a cooking liquor of 1.5 g/dl combined $SO_2$ must be used at a 4:1 liquor:wood ratio.

By acid sulfite cooking we mean, as per Rydholm, that the ratio of total $SO_2$ to combined $SO_2$ would be at least 4:1, such that the pH of the cooking acid (at room temperature) would fall in the general range of 1–2. (Reference to "Rydholm" herein is to the text *Pulping Processes,* S. A. Rydholm, Interscience Publishers, 1965.) This ratio of total $SO_2$ to combined $SO_2$ in the cooking acid at room temperature may be as great as 12:1 but will generally be lower in accordance with the free $SO_2$ concentration of the cooking acid which will typically range from 4 to 12 g/dl free $SO_2$. By free $SO_2$ we mean the portion of the $SO_2$ that is the sum of the actual free $SO_2$ plus one-half of the $SO_2$ combined as bisulfites, determined by titration according to TAPPI Standard Method T604. (This is the definition of free $SO_2$, set forth in TAPPI definition T 1201 OS-72.) The total $SO_2$ content of the cooking liquor refers to the grams of $SO_2$ per 100 ml of solution also as determined by titration according to TAPPI Standard Method T604. The total $SO_2$ concentration of a cooking liquor is the sum of the free plus the combined $SO_2$ concentrations. The actual ratio of total $SO_2$ to combined $SO_2$ will in all cases be greater than 4:1 but will vary to reflect the free $SO_2$ concentration of the cooking liquor which will not exceed 16 g/dl free $SO_2$. For example, if a cooking liquor containing 8.0 g/dl free $SO_2$ and 2.0 g/dl combined $SO_2$ or 10.0 g/dl total $SO_2$ is charged, the ratio of total $SO_2$ to combined $SO_2$ would be 5.0:1.0. If the cooking liquor contained 8.0 g/dl free $SO_2$ and 1.2 g/dl combined $SO_2$ or 9.2 g/dl total $SO_2$, the ratio of total $SO_2$ to combined $SO_2$ would be 7.7:1.0.

As previously indicated, the process of the invention uses pressures which are essentially conventional for acid sulfite digestions processes. At the maximum pressure of 170 psig, about 10% free $SO_2$ would remain when the digester temperature reached 120° C., even if free $SO_2$ had been present in greater quantity in the cooking acid (at lower temperature). For temperatures greater than 120° C., even less $SO_2$ would be present, i.e. more would be lost in relieving digester pressure at 170 psig. Less than 10% free $SO_2$ would remain in the digester liquor at 120° C. at lower, more practical maximum digester pressures, e.g. 70 to 150 psig or even more preferably 90–120 psig. Combined $SO_2$ does not contribute greatly to vapor pressure and hence its concentration would not be limited by a pressure limitation. The relationship between pressure, free $SO_2$ and temperature in an acid sulfite digestion process is more fully set forth in an article entitled "Chemical Equilibria in Heated Sulfite Solutions" by O. V. Ingruber, in *Pulp and Paper Magazine of Canada,* 66:T215 to T228, April 1965.

In the following examples, data is given for various properties of both unbleached pulp and spent sulfite liquor. The definition of this property data is set forth below.

K number (also called permanganate number, see page 1112 Rydholm) is a measure of lignin remaining in unbleached pulp. The determination is based on the fact that lignin is much more rapidly oxidized by a 0.1 N (normal) solution of potassium permanganate than the cellulose and hemicellulose present in unbleached pulp. Specifically, K number corresponds to the number of milliliters of 0.1 N potassium permanganate consumed by 1 g of dry unbleached pulp under standard conditions.

I.V. is cuene intrinsic viscosity (see page 1118 Rydholm) and refers to the intrinsic viscosity of a 0.5% solution of unbleached pulp in cuene (cupriethylenediamine hydroxide). The intrinsic viscosity of this solution is related to the average degree of polymerization of the carbohydrate polymers (cellulose and hemicellulose) in unbleached pulp. Dissolving grade pulps are usually digested to a specified I.V. Lignin is determined by hydrolyzing and dissolving the cellulose and hemicellulose is hot 72% sulfuric acid. A portion of the lignin (insoluble lignin) remains as an insoluble residue that is collected and dried. Another portion goes into solution and is termed soluble lignin; it is measured in solution by a spectroscopic method. These lignins are expressed as a percentage of the dry unbleached pulp. A higher portion of soluble lignin is considered desirable.

$S_{10}$ and $S_{18}$ (see Rydholm page 1116 and 1117) refer to the solubility of unbleached pulp in 10 and 18% solutions of caustic under a standard set of conditions. $S_{18}$ is a reflection of the amount of hemicellulose, whereas $S_{10}$ is a reflection of the amount of degraded cellulose plus hemicellulose present in the unbleached pulp. Lignin is removed from the pulp by a chlorite oxidation method before alkali solubility determinations are made (see Rydholm page 1118).

Xylan and mannan content are a reflection of the two major types of hemicellulose present in chemical wood pulp. Xylan is a major constituent of one type, whereas mannan is a major constituent of the other. Xylan and mannan were measured by hydrolyzing pulp to its monomeric components with an acid solution, and measuring the liberated xylose and mannose by a paper chromatographic technique.

Tailings refers to that portion of wood chips that are not digested to the point where the wood fibers separate. Tailings are removed from the liberated fibers by a screening method. Screened yield is the percent of dry unbleached pulp (based on dry wood) recovered after digestion and screening to remove tailings. The percent dry weight of tailings removed is also based on the dry weight of wood digested.

Brightness refers to the amount of reflected light coming from a sheet of pulp compared to the amount of reflected light from a standard white plate. Measurements are made in an Elrepho photoelectric reflection photometer No. 50-38-00 under standard conditions. Higher unbleached pulp brightness implies improved delignification during digestion.

The following example illustrate the practice of the invention. Unless otherwise indicated, all parts and percentages are by weight.

EXAMPLE 1

Western hemlock wood chips (65.8 kg) containing 48.6% dry wood were placed in a 0.2 $m^3$ capacity stainless steel laboratory pulping digester. Chips were of typical commercial size having the following average dimensions: length, 19.8 mm; width, 19.0 mm; thickness, 3.7 mm. After placing on the lid, 160 l of ammonium base cooking liquor having a composition falling in the range of the invention (7.25 g/dl free $SO_2$, and 1.22 g/dl combined $SO_2$) was pumped into the digester. The combined $SO_2$ to wood was 6.1 kg of combined $SO_2$ to 100 kg of oven dried wood. The system was then heated by circulating the liquor out of the top of the digester, through a steam-heated heat exchanger, and back into the digester bottom. The average heating rate to the maximum cooking temperature was 64° C./hr (1.07° C./min), bringing the system from 20° C. to 148° C. in 2.0 hr. The digester pressure was not allowed to exceed 758 kPa(g). After holding the digester at 148° C. for 1 hr and 55 min, the pressure was lowered to 551 kPa(g) and the digester contents blown to a tank at atmospheric pressure. Total digestion time was 3 hrs and 55 min.

The unbleached pulp and spent sulfite pulping liquor (SSL) were separated with a centrifuge. The pulp was then washed with water and passed through a screen with 0.2 mm slots to remove tailings and dewatered to 31.7% dry weight, and weighed. Material not passing the screen (tailings) were collected, dried and weighed.

A portion of the SSL was stripped of free $SO_2$ by counter current contact with steam in a packed column under 200 kPa(g) of pressure. Stripped liquor was evaporated to 50% solids at atmospheric pressure in an indirect-contact steam-heated evaporator. Viscosity of the evaporated liquor was measured on a Brookfield viscometer.

EXAMPLE 2

A second digestion typical of conventional acid sulfite pulping was performed in a similar manner except the cooking liquor contained 7.17 g/dl free $SO_2$ and 0.65 g/dl combined $SO_2$, and that the digester was heated from 20° C. to 142° C. in 3 hr and 30 min, an average heating rate of 34.9° C./hr (0.58° C./min). The combined $SO_2$ to wood ratio was 3.3 (kg of $SO_2$ to 100 kg of oven dried wood). The digester was held at 142° C. for 50 min before blowing. Total digestion time was 4 hr and 20 min. The maximum cooking temperature in Example 1 was 6° higher than in this Example 2. It is desirable, although not necessary as demonstrated in further examples below, that such a higher temperature be used to help shorten total cooking time.

Properties of the unbleached pulp and SSL from Examples 1 and 2 are set forth in Table I.

TABLE 1

| | Invention Example 1 | Conventional Acid Sulfite Example 2 |
|---|---|---|
| Unbleached Pulp | | |
| Screened yield, % | 46.5 | 47.2 |
| Tailings, % | 0.5 | 0.5 |
| I.V., dl/g | 11.0 | 10.8 |
| K number | 8.8 | 11.6 |
| K no./I.V. | 0.80 | 1.07 |
| $S_{10}$, % | 10.5 | 11.8 |
| $S_{18}$, % | 9.0 | 10.2 |
| Xylan, % | 2.0 | 1.8 |
| Mannan, % | 4.6 | 5.5 |
| Xylan plus mannan, % | 6.6 | 7.3 |
| Lignin, soluble, % | 1.50 | 1.40 |
| Lignin, insoluble, % | 0.09 | 0.42 |
| Total lignin (%) | 1.59 | 1.82 |
| Brightness, % | 60.2 | 53.0 |
| Spent Liquor | | |
| Unstripped SSL pH | 3.14 | 1.87 |
| Stripped SSL pH | 4.54 | 3.11 |
| Stripped and evaporated SSL viscosity at 90° C., mPa.s | 27 | 60 |

It can be seen from the table that the process of the invention, compared with conventional acid sulfite pulping, can give pulp of about the same yield, tailings and I.V., but with the advantages of 25 min shorter digestion time, and improved pulp lignin and hemicellulose contents and higher brightness. Furthermore, as more fully discussed below, the waste liquor from the invention has a higher pH, making it less corrosive to process equipment. Also, evaporating the invention SSL produces a lower viscosity heavy liquor that would be more economic to burn in a recovery boiler.

The cooking curves of Examples 1 and 2 are shown in FIG. 1 together with a representative curve of an acid sulfite mill digestion process. The mill curve is shown because time-temperature curves in the mill typically differ in certain respects from comparable laboratory runs of the type shown in Examples 1 and 2. As shown in FIG. 1, the maximum cooking temperature is reached in two hours in Example 1 and in 3½ hours in the prior art process of Example 2. In the mill curve the maximum cooking temperature (140° C.) is reached after 3 hours. However, the temperature frequently rises a few degrees (e.g. 1° to 10° C.) in mill digestion operations after achieving "maximum cooking temperature" and for this reason, the term "substantially the maximum cooking temperature" is herein used to define the end of the rapid temperature rise, namely 140° C. at three hours in the mill curve of FIG. 1. In practice, the temperature may rise a few degrees above 140° C. in a mill operation after the "substantially maximum temperature" is reached at the end of the three hour period in FIG. 1. Note also that the mill curve starts with a 60° C. cooking liquor and that the temperature tails off at the end of the digestion cycle, as is typical of mill operations.

The corrosivity of the unstripped SSL of Examples 1 and 2 to 317L stainless steel was evaluated by potentiodynamic polarization using a Princeton Applied Research Model 331-1 corrosion measurement system. The temperature was 65° C. Traditionally, 317L stainless steel (SS) is one of the materials used in commercial equipment made to handle SSL.

Anodic polarization curves of the SSL are shown in FIG. 2. In this technique, an increasing protential is applied between a 5 $cm^2$ metal anode (317L SS) and an inert saturated colomel electrode (SCE), or cathode, and the resultant currents measured.

As the anodic polarization increases, passivation occurs; i.e., the current flowing from the anode goes through maximum, then decreases to the passive current density. This indicates that the stainless steel has the ability to self passivate. The wider the passive potential range, the more likely that anodic passivation will occur, and that the stainless steel will resist corrosion. It can be seen from FIG. 2 that SSL from the invention has a wider passive potential range than for SSL from the conventional acid sulfite process. The anodic curve of the invention starts at a lower potential than the conventional process because of a higher pH.

EXAMPLES 3–7

Two digestion runs were carried out as in Example 1 but using sodium base rather than ammonium base cooking liquor. Hemlock wood chips were used as furnish. Table II compares the results of these digestion runs with two similar runs carried out in accordance with conventional acid sulfite digestion processes and one run in accordance with conventional bisulfite digestion processes. Examples 5 and 6 at 3.1 combined $SO_2$ to wood ratio is a typical conventional acid sulfite ratio for dissolving grade pulp. By comparison, Example 7 is typical of bisulfite pulping suitable for paper end use. Note that the combined $SO_2$ to wood in Example 7 is much higher (8.7) than Examples 5 and 6. Note also that the maximum temperature used is over twenty degrees higher for the bisulfite cook than for the conventional acid sulfite cooks. In addition, total cooking time is long, approaching six hours for Example 7. Higher maximum temperature and longer total cooking times are well known to be required in bisulfite pulping to compensate for the slowing down of the delignification rate which is caused by the higher levels of combined $SO_2$ to wood.

The cooking conditions and the resulting unbleached pulp and spent liquor properties for these five examples (except where not measured) are set forth in Table II.

TABLE II

| | Example No. | | | | |
|---|---|---|---|---|---|
| | | | Conventional | | |
| | Invention | | Acid Sulfite | | Bisulfite |
| Process | 3 | 4 | 5 | 6 | 7 |
| Cooking Conditions | | | | | |
| Combined $SO_2$ (g/dl) | 1.20 | 1.22 | 0.66 | 0.66 | 1.9 |
| Free $SO_2$ (g/dl) | 6.93 | 7.09 | 7.05 | 7.08 | 1.9 |
| Total $SO_2$/Combined $SO_2$ | 6:1 | 6:1 | 12:1 | 12:1 | 2:1 |
| Combined $SO_2$:Wood (kg/100 kg O.D.) | 6.0 | 6.1 | 3.3 | 3.3 | 8.7 |
| Maximum Temperature (°C.) | 148 | 148 | 142 | 142 | 165 |
| Time to (hrs:min) | 2:00 | 2:00 | 3:30 | 3:30 | 3:00 |
| Time at (hrs:min) | 1:55 | 1:55 | 0:45 | 0:50 | 2:45 |
| Average Heating Rate to (°C./hr) | 64 | 64 | 34.9 | 34.9 | 48.3 |
| Total Cooking Time (hrs:min) | 3:55 | 3:55 | 4:15 | 4:20 | 5:45 |
| Pulp Properties | | | | | |
| Screened Yield (%) | 44.0 | 44.7 | 45.7 | 44.5 | 53.6 |
| Tailings (%) | 0.7 | 0.6 | 0.4 | 0.7 | 0.6 |
| I.V. (dl/g) | 10.5 | 10.9 | 11.2 | 10.0 | 11.6 |
| K Number | 8.4 | 8.8 | 10.7 | 10.2 | 19.8 |
| K No./I.V. Ratio | 0.80 | 0.81 | 0.96 | 1.02 | 1.71 |
| Total Lignin (%) | 2.5 | 1.9 | 2.4 | 2.0 | — |
| Lignin Soluble (%) | 1.4 | 1.6 | 1.3 | 0.9 | — |
| Lignin Insoluble (%) | 1.1 | 0.3 | 1.1 | 1.1 | — |
| $S_{10}$ (%) | 11.2 | 11.3 | 12.0 | 12.0 | — |
| $S_{18}$ (%) | 9.6 | 9.7 | 10.9 | 10.2 | — |

TABLE II-continued

| Process | Example No. Invention 3 | 4 | Conventional Acid Sulfite 5 | 6 | Bisulfite 7 |
|---|---|---|---|---|---|
| Brightness, % | 56.8 | 54.2 | 50.3 | 49.8 | — |
| Spent Liquor | Combined | | Combined | | |
| Unstripped pH | 3.00 | | 1.75 | | — |
| Stripped pH | 4.35 | | 3.05 | | — |
| Vanillin Yield (gm/gm SSL solids) | 0.042 | | 0.038 | | — |

Table II shows that Examples 3 and 4 of the invention produced at shorter times pulp properties which were at least equivalent to the conventional acid sulfite pulps of Examples 5 and 6. Note also that Examples 3 and 4 had lower K No./I.V. ratios. "K number" is a measure of the lignin content of the pulp, the lower the K No., the less lignin in the pulp. I.V. is a measure of degradation of the pulp, the higher the I.V., the less degradation. Thus the lower the ratio of K No./I.V., the better the quality of the pulp within a given I.V. range. After almost six hours of cooking the bisulfite pulp of Example 7 is characterized by poorer delignification than acid sulfite Examples 5 and 6. Table II also shows higher pH's and improved vanillin yields from the spent sulfite liquors of the examples of the invention.

EXAMPLES 8-12

A further series of laboratory pulping runs were made to compare the effects of rapid heating schedules on conventional acid sulfite and conventional bisulfite combined/wood ratios. All parameters of the process were those of conventional runs except for the heating schedule. All examples used sodium base cooking liquor and hemlock wood chips. The cooking conditions and the results of each of these runs are set forth in Table III.

TABLE III

| Process | Example No. Acid Sulfite Conventional 8 | Acid Sulfite Fast Heating 9 | 10 | Bisulfite Conventional 11 | Bisulfite Fast Heating 12 |
|---|---|---|---|---|---|
| Cooking Conditions | | | | | |
| Combined $SO_2$ (g/dl) | 0.65 | 0.64 | 0.65 | 1.90 | 1.91 |
| Free $SO_2$ (g/dl) | 7.2 | 6.9 | 7.2 | 1.9 | 1.9 |
| Total $SO_2$/Combined $SO_2$ | 12/1 | 12/1 | 12/1 | 2/1 | 2/1 |
| Combined $SO_2$Wood (kg/100 kg O.D,) | 3.3 | 3.2 | 3.3 | 10.9 | 11.2 |
| Maximum Temperature (°C.) | 142 | 142 | 142 | 165 | 165 |
| Time to (hrs:min) | 3:30 | 2:00 | 1:00 | 3:00 | 1:00 |
| Time at (hrs:min) | 0:30 | 1:00 | 2:00 | 2:45 | 2:45 |
| Average Heating Rate to (°C./hr) | 34.5 | 61.0 | 122.0 | 48.3 | 145.0 |
| Total Cooking Time (hrs:min) | 4:00 | 3:00 | 3:00 | 5:45 | 3:45 |
| Maximum Pressure (kPa(g)) | 758 | 758 | 758 | 1240 | 1240 |
| Cooking Liquor pH | 1.5 | 1.3 | 1.5 | 3.1 | 4.0 |
| Pulp Properties | | | | | |
| Screened Yield (%) | 49.3 | 45.6 | — | 48.9 | 51.7 |
| Tailings (%) | 0.8 | 3.9 | 11.6 | 0.3 | 2.3 |
| K No./I.V. Ratio | 1.40 | 3.05 | 2.70 | 1.76 | 2.32 |
| I.V. (dl/g) | 10.5 | 7.9 | 8.6 | 10.3 | 11.7 |
| K Number | 14.7 | 24.0 | 23.2 | 18.1 | 27.2 |
| Total Lignin (%) | 3.5 | 5.8 | 5.6 | — | — |
| Lignin, Soluble (%) | 1.2 | 0.4 | 0.8 | — | — |
| Lignin, Insoluble (%) | 2.3 | 5.4 | 4.8 | — | — |
| Brightness (%) | 40.8 | 35.8 | 33.0 | — | — |
| Xylan (%) | 1.6 | 1.4 | 1.6 | — | 2.6 |
| Mannan (%) | 4.8 | 3.8 | 3.8 | — | 10.5 |
| Total Xylan plus Mannan (%) | 6.4 | 5.2 | 5.4 | — | 13.1 |

It will be seen by examination of Table III, in which all examples are outside the scope of the invention, that the acid sulfite pulps produced with fast heat (Examples 9 and 10) exhibit higher tailings, higher K numbers, higher K No./I.V. ratios as compared to the corresponding conventional process. Furthermore, Examples 9 and 10 show evidence of lignin condensation (compare insoluble lignin contents) and carbohydrate degradation as evidenced by lower I.V.'s. These data substantiate the well known properties of a burnt cook in conventional acid sulfite pulping. The success of the corresponding cooks using the process of the invention under the same rates of heating indicates that it is the overall quantity of combined $SO_2$/wood which limits the rate of heating in conventional acid sulfite pulping.

Examples 11 and 12 in Table III also shows the effect of fast heating rise on bisulfite cooking. The K No./I.V. ratio and tailings increase as in fast rise conventional acid sulfite pulping. Also as in conventional acid bisuflite pulping, the use of a fast rise to maximum temperature to reduce total cooking time is not plausible with bisulfite pulping because pulp quality is impaired as evidenced by the 50% jump in K number. Table III supports the conclusion that the success of the process of the invention is the result of coupling a fast temperature rise with an appropriate cooking acid combined ratio and substantial amounts of free $SO_2$.

EXAMPLES 13-15

These examples illustrate the preparation of an acid sulfite pulp to a target I.V. of 11 from slash pine furnish with an ammonium base cooking liquor. Examples 13 and 14 are in accordance with the invention. Example 15 is a comparable acid sulfite digestion process using a conventional combined $SO_2$ to wood ratio and heating rate. The maximum cooking pressure in all examples was 758 KPa gauge. The digestion conditions and pulp and spent liquor properties are set forth in Table IV.

TABLE IV

| Process | Example No. Invention 13 | Invention 14 | Conventional 15 |
|---|---|---|---|
| Cooking Conditions | | | |
| Combined $SO_2$ (g/dl) | 1.51 | 1.19 | 0.85 |
| Free $SO_2$ (g/dl) | 6.95 | 6.93 | 6.99 |
| Combined $SO_2$:Wood (kg/100 kg O.D.) | 5.6 | 4.4 | 3.2 |
| Maximum Temperature (°C.) | 145 | 145 | 140 |
| Time to (hrs:min) | 2:00 | 2:15 | 4:00 |
| Time at (hrs:min) | 2:45 | 2:05 | 1:29 |
| Average Heating Rate to (°C./hr) | 62.5 | 55.6 | 30.0 |
| Total Cooking Time (hrs:min) | 4:45 | 4:20 | 5:29 |
| Pulp Properties | | | |
| Screened Yield (%) | 45.8 | 45.9 | 46.3 |
| Tailings (%) | 1.6 | 1.8 | 1.9 |
| I.V. (dl/g) | 11.1 | 11.1 | 10.8 |
| K Number | 8.0 | 9.5 | 10.1 |
| K No./I.V. Ratio | 0.72 | 0.86 | 0.94 |
| Total Lignin (%) | 2.1 | 2.1 | 3.3 |
| Lignin Soluble (%) | 1.4 | 1.4 | 1.0 |
| Lignin Insoluble (%) | 0.7 | 0.7 | 2.3 |
| $S_{10}$ (%) | 10.3 | 10.1 | 10.9 |
| $S_{18}$ (%) | 8.6 | 8.6 | 9.2 |
| Brightness (%) | 67.2 | 64.4 | 61.5 |
| Spent Liquor | | | |
| Unstripped pH | 2.55 | 2.3 | 1.9 |
| Stripped pH | 4.1 | 3.9 | 2.7 |

It will be seen from Table IV that a pulp of improved K number, K No./I.V. ratio, lignin content and brightness was produced in accordance with the invention at a significant reduction in digestion time. It should also be noted from the $S_{18}$ results that the hemicellulose level is unexpectedly low for the total cooking times and combined $SO_2$/wood levels used. At these cooking times and combined levels, it would normally be expected to have higher hemicellulose levels. This is further shown in the following Examples 16 and 17 and Table V. Finally, the pH levels of the spent sulfite liquor are significantly higher for Examples 13 and 14 of the invention.

EXAMPLES 16 and 17

Two pulping runs were made to compare fast heating in accordance with the invention with conventional heating, both runs using a high combined level within the scope of the invention. Both samples used sodium base cooking liquors and hemlock wood chips. Maximum pressure was 758 kilopascals gauge in both examples. The results are set forth in Table V.

TABLE V

| Process | Example No. Invention 16 | Conventional 17 |
|---|---|---|
| Cooking Conditions | | |
| Combined $SO_2$ (g/dl) | 1.19 | 1.16 |
| Free $SO_2$ (g/dl) | 7.18 | 7.24 |
| Total $SO_2$/Combined $SO_2$ | 7/1 | 7/1 |
| Combined $SO_2$/Wood (kg/100 kg O.D.) | 6.0 | 5.8 |
| Maximum Temperature (°C.) | 142 | 142 |
| Time to (H:M) | 1:00 | 3:30 |
| Time at (H:M) | 2:00 | 0:30 |
| Average Heating Rate to (°C./hr) | 122.0 | 34.8 |
| Total Cooking Time (H:M) | 3:00 | 4:00 |
| Cooking Liquor pH | 1.5 | 1.4 |
| Unbleached Stock | | |

TABLE V-continued

| Process | Example No. Invention 16 | Conventional 17 |
|---|---|---|
| Screened Yield (%) | 45.8 | 53.3 |
| Tailings (%) | 2.8 | 0.6 |
| K No/I.V. Ratio | 1.42 | 1.70 |
| I.V. (dl/g) | 12.7 | 14.9 |
| K Number | 17.9 | 25.2 |
| Total Lignin (%) | 2.6 | — |
| Lignin, Soluble (%) | 1.6 | — |
| Lignin, Insoluble (%) | 1.0 | — |
| Brightness (%) | 44.5 | 40.8 |
| $S_{10}$ (%) | 11.5 | 13.9 |
| $S_{18}$ (%) | 10.3 | 12.9 |
| Xylan (%) | 2.1 | 2.3 |
| Mannan (%) | 4.6 | 6.1 |
| Xylan plus Mannan (%) | 6.7 | 8.4 |

Table V shows that at a high combined $SO_2$ level, the process of the invention has produced a 12.7 I.V. pulp and a 17.9 K number while Example 17, at the same high combined level but at conventional heating rate, produced a higher I.V. and K number pulp in an hour longer total cooking time. Note also a lower hemicellulose content of Example 17 as evidenced by lower $S_{18}$ and total xylan and mannan content.

EXAMPLES 18-19

Two digestion runs were made at the same maximum cooking temperature and to the same approximate I.V. range. The I.V. range used in this example is typical of paper grade pulps. The first of these runs, Example 18, was in accordance with conventional acid sulfite digestion practice with respect to combined $SO_2$ to wood ratio, heating rate and cooking time. Example 19 was within the scope of the invention. Both examples used slash pine furnish, an ammonium base cooking liquor and a maximum cooking pressure of 758 KPa gauge. The cooking conditions and pulp properties are set forth in Table VI.

TABLE VI

| Process | Example No. Conventional 18 | Invention 19 |
|---|---|---|
| Cooking Conditions | | |
| Combined $SO_2$ (g/dl) | 0.65 | 1.70 |
| Free $SO_2$ (g/dl) | 7.30 | 7.09 |
| Combined $SO_2$:Wood (Kg/100 Kg O.D.) | 3.3 | 8.5 |
| Maximum Temperature (°C.) | 142 | 142 |
| Time to (hrs:min) | 3:30 | 1:00 |
| Time at (hrs:min) | 0:30 | 2:30 |
| Average Heating Rate to (°C:/hr) | 34.9 | 122.0 |
| Total Cooking Time (hrs:min) | 4:00 | 3:30 |
| Pulp Properties | | |
| Screened Yield (%) | 45.6 | 48.5 |
| Tailings (%) | 3.0 | 3.4 |
| I.V. (dl/g) | 11.9 | 12.6 |
| K Number | 19.5 | 15.7 |
| K No./I.V. Ratio | 1.64 | 1.25 |
| Total Lignin (%) | 3.5 | 4.0 |
| Lignin Soluble (%) | 0.2 | 2.9 |
| Lignin Insoluble (%) | 3.3 | 1.1 |
| Xylan Plus Mannan (%) | 8.0 | 9.0 |
| $S_{10}$ (%) | 11.1 | 10.8 |
| $S_{18}$ (%) | 9.1 | 9.0 |
| Brightness (%) | 48.5 | 57.6 |

It will be seen that the process of the invention, Example 19, arrived at approximately the same I.V. range as conventional Example 18 with less cooking time and produced a pulp of slightly better quality as evidenced by K number and K No./I.V. ratio. Table VI also indicates that the maximum temperature for the process of the invention need not be any higher than that used in conventional acid sulfite cooking, whereas bisulfite conditions which use high combined $SO_2$ to wood ratios require a higher cooking temperature to effectively defiber the wood. See Example 7 above which shows a conventional bisulfite process using a combined $SO_2$ to wood ratio of 8.7 which is comparable to Example 19 but which requires a maximum cooking temperature of 165° C.

EXAMPLES 20–21

Examples 20 and 21 compare the use of cooking liquor at ambient temperature with a substantially identical digestion run starting with a hot cooking liquor to simulate a mill run. Ammonium base cooking liquors having a combined $SO_2$ level within the scope of the invention were pumped from a holding vessel into a laboratory digester containing hemlock chips. In Example 20, the cooking acid was pumped to the digester without first heating the liquor, whereas in Example 21 the liquor was first heated to 96° C. The maximum cooking pressure in both examples was 758 KPa(g). The same heating curve was used in both examples, however 35 minutes was eliminated from the first portion of the cooking curve of Example 20 by starting with hot cooking liquor. This time saving is reflected in the 35 minute shorter total cooking time of Example 21 compared with Example 20. The results are set forth in Table VII.

TABLE VII

| Example No. | 20 | 21 |
|---|---|---|
| Cooking Conditions | | |
| Combined $SO_2$ (g/dl) | 1.20 | 1.19 |
| Free $SO_2$ (g/dl) | 7.02 | 6.93 |
| Combined $SO_2$:Wood (Kg/100 Kg O.D.) | 6.3 | 6.3 |
| Temperature at Start of Heating (°C.) | 20 | 84 |
| Maximum Temperature (°C.) | 142 | 142 |
| Time to (hrs:min) | 2:00 | 1.25 |
| Time at (hrs:min) | 1:30 | 1:30 |
| Average Heating Rate to (°C./hr) | 61.0 | 40.9 |
| Average Heating Rate to 110° C. (°C./hr) | 83.1 | 62.4 |
| Total Cooking Time (hrs:min) | 3:30 | 2:55 |
| Pulp Properties | | |
| Screened Yield (%) | 47.4 | 48.9 |
| Tailings (%) | 1.5 | 1.6 |
| I.V. (dl/g) | 14.0 | 14.0 |
| K Number | 15.6 | 21.6 |
| K No./I.V. Ratio | 1.11 | 1.54 |

Examples 20 and 21 and Table VII show that the invention is equally applicable to the use of both ambient temperature and preheated cooking liquor, the latter being commonly used in commercial practice. Since the heating curves are not linear, the heating rate is influenced by the starting temperature of the cooking liquor.

Thus, the process of the invention greatly enlarges the range of cooking parameters acceptable in acid sulfite digestion processes. This flexibility permits increased productivity by allowing an overall reduction in digester cooking time, typically 10–25% or even more. The process produces spent sulfite liquor whose physical and chemical characteristics are improved and which is more compatible with effluent recovery systems. The process also makes possible the production of improved quality pulp with lower bleach chemical requirements because of reduced lignin content.

I claim:

1. In a process of digesting wood to produce chemical pulp by the acid sulfite digestion process in which the ratio by weight of total $SO_2$ to combined $SO_2$ is at least 4 to 1 comprising heating in a closed vessel wood chips in an acid sulfite cooking liquor having a concentration of free $SO_2$ no greater than 16% to a maximum cooking temperature no greater than 180° C. and at a maximum pressure no greater than 170 psig for a period of time sufficient to defiber the wood, the improvement in which the ratio by weight of one part of combined $SO_2$ to 100 parts of dry wood is from 4 to 12 and the minimum average rate of heating to a temperature which is the substantially maximum cooking temperature is 40° C. per hour.

2. The process of claim 1 in which the temperature is raised to substantially the maximum temperature from an ambient temperature cooking liquor in a time of less than $2\frac{1}{2}$ hours.

3. The process of claim 1 in which the temperature is raised to substantially the maximum temperature from a heated cooking liquor in a time of less than 2 hours.

4. The process of claims 2 or 3 in which the time is less than $1\frac{1}{2}$ hours.

5. The process of claim 1 in which the ratio of combined $SO_2$ to wood is 4.5 to 9.

6. The process of claim 1 in which the ratio of combined $SO_2$ to wood is at least 5.

7. The process of claim 1 in which the average minimum rate of heating is 50° C. per hour.

8. The process of claim 1 in which the initial pH of the cooking liquor ranges from about 1 to 2.

9. The process of claim 1 in which the ratio by weight of total $SO_2$ to combined $SO_2$ ranges from 4 to 12.

10. The process of claim 1 in which the process is a single stage digestion process.

11. The process of claim 1 in which the process is a soluble base digestion process.

12. The process of claim 1 in which the concentration of free $SO_2$ ranges from 4 to 12% and does not exceed 10% at cooking temperatures above 120° C.

13. The process of claim 1 in which the maximum pressure is 150 psig.

* * * * *